US010352147B2

(12) United States Patent
Kehoe

(10) Patent No.: US 10,352,147 B2
(45) Date of Patent: Jul. 16, 2019

(54) HORIZONTAL EXTENDED REACH BOREHOLE CLEANUP TOOL

(71) Applicant: BAKER HUGHES, A GE COMPANY, LLC, Houston, TX (US)

(72) Inventor: Stephen F. Kehoe, Canton, OH (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 358 days.

(21) Appl. No.: 14/945,135

(22) Filed: Nov. 18, 2015

(65) Prior Publication Data

US 2017/0138165 A1 May 18, 2017

(51) Int. Cl.
*E21B 34/06* (2006.01)
*E21B 43/08* (2006.01)
*E21B 43/38* (2006.01)

(52) U.S. Cl.
CPC ..... *E21B 43/38* (2013.01); *E21B 34/06* (2013.01); *E21B 43/08* (2013.01)

(58) Field of Classification Search
CPC ..... E21B 27/00; E21B 37/00; E21B 43/38; E21B 27/005; E21B 27/04; E21B 43/124
See application file for complete search history.

(56) References Cited

U.S. PATENT DOCUMENTS 4,296,822 A * 10/1981 Ormsby ..... E21B 10/48 175/237
4,505,341 A * 3/1985 Moody ..... E21B 21/00 166/105.1
4,744,420 A * 5/1988 Patterson ..... E21B 7/18 166/105
4,924,940 A * 5/1990 Burroughs ..... E21B 27/00 166/105.1
5,295,537 A * 3/1994 Trainer ..... E21B 43/38 166/105.1
6,158,512 A * 12/2000 Unsgaard ..... E21B 37/08 166/105.1
6,176,311 B1 1/2001 Ryan
6,189,617 B1 * 2/2001 Sorhus ..... E21B 27/00 166/162
6,978,841 B2 * 12/2005 Hoffman ..... E21B 23/04 166/222
7,478,687 B2 1/2009 Lynde et al.
8,607,857 B2 12/2013 Lynde et al.
8,844,629 B2 9/2014 Armstrong
8,960,282 B2 2/2015 Zhu
(Continued)

*Primary Examiner* — Daniel P Stephenson
(74) *Attorney, Agent, or Firm* — Shawn Hunter

(57) ABSTRACT

A debris collection device creates circulation with surface pumped fluid that draws debris laden flow into a long tail pipe. The tail pipe advances as debris is sucked out of the way and into the tailpipe. A shoe with a check valve at the tailpipe lower end prevents debris exit from the tailpipe either when the surface pump is turned off or when the tailpipe is removed with the tool to get the debris out of the borehole. The device handles horizontal runs where debris such as sand accumulates on the borehole bottom. Additional stands are added above the debris collection device as the tailpipe penetrates deeper into the borehole as sand that lies ahead of it is removed into the tailpipe. A volume of sand extending into the thousands of gallons can be removed in a single trip.

17 Claims, 1 Drawing Sheet

(56) References Cited

U.S. PATENT DOCUMENTS

| | | | | |
|---|---|---|---|---|
| 9,038,736 | B2 * | 5/2015 | Knobloch, Jr. | E21B 21/12 166/378 |
| 9,353,590 | B2 * | 5/2016 | Soni | E21B 27/04 |
| 2010/0288492 | A1 * | 11/2010 | Blackman | E21B 27/005 166/250.1 |
| 2011/0024119 | A1 * | 2/2011 | Wolf | E21B 34/06 166/301 |
| 2012/0118571 | A1 * | 5/2012 | Zhou | E21B 27/00 166/301 |
| 2015/0345276 | A1 * | 12/2015 | Jensen | E21B 27/00 166/265 |
| 2017/0138165 | A1 * | 5/2017 | Kehoe | E21B 43/38 |
| 2018/0238143 | A1 * | 8/2018 | Falk | E21B 33/127 |

* cited by examiner

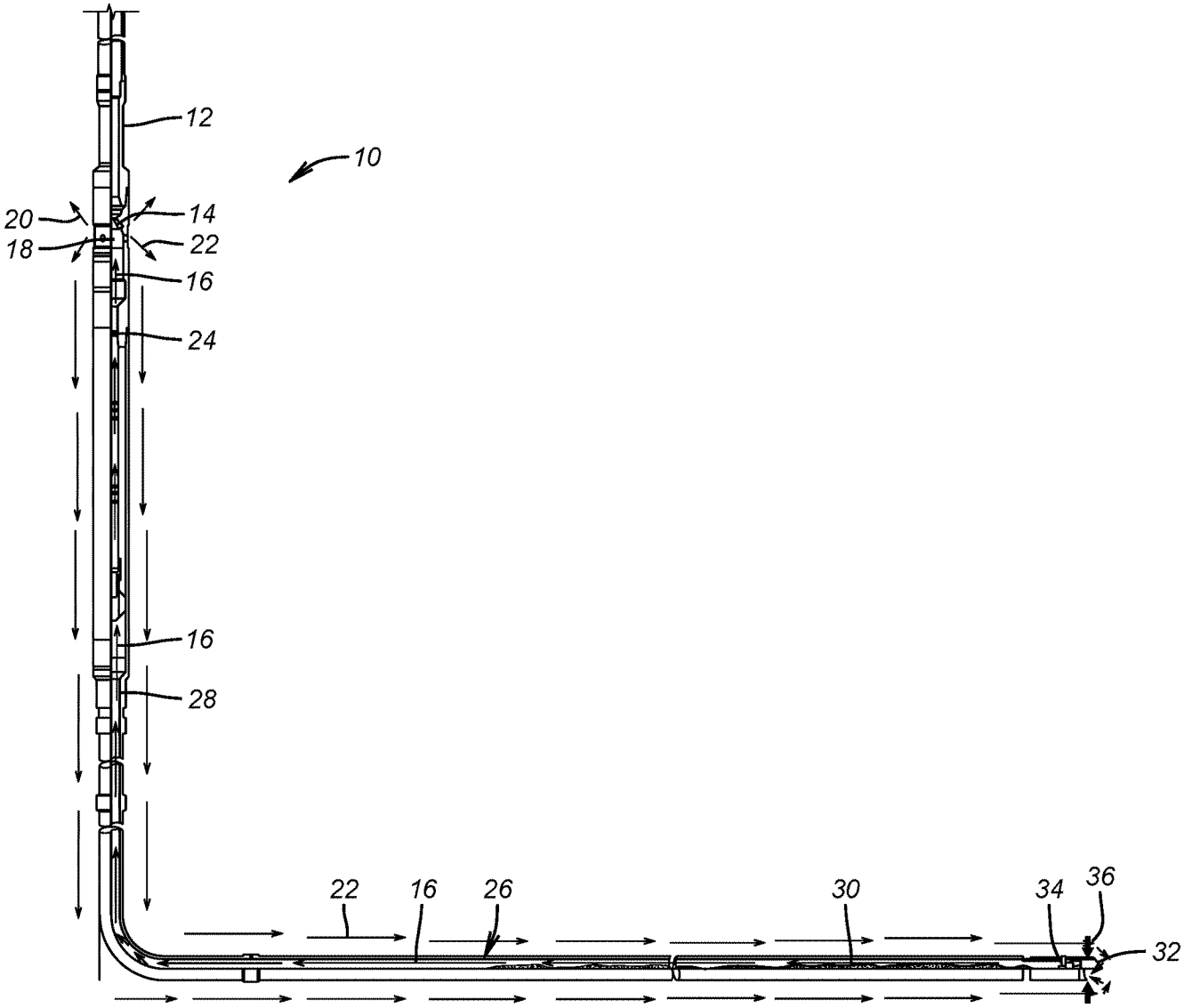
10
12
14
22
16
24
16
28
20
18
22
16
26
30
34
36
32

HORIZONTAL EXTENDED REACH BOREHOLE CLEANUP TOOL

FIELD OF THE INVENTION

The field of the invention is borehole cleanup tools and more particularly tools adapted for cleaning extended horizontal runs and retaining captured debris when circulation stops to add pipe for tool advancement.

BACKGROUND OF THE INVENTION

Wellbore debris cleanup tools have in the past focused on maintaining debris laden fluid flow velocity into the tool body through a narrow inlet pipe. At the top of the inlet pipe the diameter grew and the velocity slowed and the intent was for the larger debris to fall into a surrounding annular space around the inlet pipe. The top of the inlet pipe has a cone shaped cover spaced from the pipe end to act as an incoming flow diverter so that the debris would be over the annularly shaped connection volume while the remaining incoming flow with some finer debris would be drawn through a screen and then mixed with motive fluid for the educator that drew the intake flow into the housing. This basic tool is offered by Baker Hughes Incorporated of Houston, Tex. USA under the name VACS®. This patent again illustrates a small centrally located inlet pipe 100 in FIG. 8 designed to maintain flow velocity for solids entrainment. Similar designs from the same source are U.S. Pat. Nos. 8,960,282; 6,176,311 and 7,478,687. One adaptation of this design is shown in U.S. Pat. No. 8,607,857 where there is an articulated pickup tube to reach into recesses in a blowout preventer.

While these designs function well enough in generally vertical applications there are other instances where there are long horizontal runs where debris, mainly sand, amasses and can cause the well flow to decline. Those skilled in the art have used coiled tubing but have struggled to get the debris laden fluid back to surface on low pressure wells. The option of using foamed fluids or concentric coiled tubing to get the debris to surface is expensive and requires special equipment and expertise. The present invention addresses such a situation with a long tail pipe on a vacuum cleanup tool that incorporates a bottom shoe featuring a one way valve to hold the contained sand from coming out of the tailpipe when circulation stops to add additional string above the cleanup tool so that the tailpipe can advance further into the horizontal run that has filled with sand. The one way valve can be a flapper valve or an assembly of spring loaded fingers that get pulled back and out of the way with circulation. The tail pipe progresses into the horizontal run and captures the sand or other debris inside with the aid of the one way valve fingers. Borehole as used herein refers to a wellbore extending to a subterranean location, for example.

These and other aspects of the present invention will be more readily apparent to those skilled in the art after a review of the detailed description of the preferred embodiment and the associated drawing while recognizing that the full scope of the invention is to be determined by the appended claims.

SUMMARY OF THE INVETION

A debris collection device creates circulation with surface pumped fluid that draws debris laden flow into a long tail pipe. The tail pipe advances as debris is sucked out of the way and into the tailpipe. A shoe with a check valve at the tailpipe lower end prevents debris exit from the tailpipe either when the surface pump is turned off or when the tailpipe is removed with the tool to get the debris out of the borehole. The device handles horizontal runs where debris such as sand accumulates. Additional stands are added above the debris collection device as the tailpipe penetrates deeper into the borehole as sand that lies ahead of it is removed into the tailpipe. A volume of sand extending into the hundreds of gallons can be removed in a single trip.

BRIEF DESCRIPTION OF THE DRAWING

The FIGURE shows a part section assembly view of the tool and tailpipe in a horizontal borehole application.

DETAILED DESCRIPTION OF THE PREFERRED EMBODIMENT

The FIGURE shows the tool 10 supported by a string 12 extending to a surface location for the borehole in which tool 10 is inserted. Flow through string 12 exits a nozzle 14 that pulls fluid represented by arrow 16 into chamber 18 and into the surrounding annulus where some of the flow represented by arrow 20 goes uphole and the rest represented by arrow 22 goes downhole. Flow 16 goes through a screen 24 before reaching chamber 18 to minimize erosion near nozzle 14 from entrained debris such as sand. Tool 10 has a long tailpipe 26 extending from housing 28. Flow 22 continues to the toe of the well where the tailpipe 26 extends. Those skilled in the art will appreciate that the toe location moves as the debris 30 is pushed into the shoe 32 at the end of the tailpipe 16. The shoe 32 has openings where debris laden flow enters the tailpipe 26 as represented by arrows 34. Flow represented by arrows 34 pushes up spring loaded fingers 36 in a circumferential array to allow the debris to enter and prevent debris 30 from exiting tailpipe 26 even if surface pumping stops. Surface pumping stops every time another stand is added to string 12 to allow further insertion of the tailpipe into the horizontal borehole as more debris such as sand is vacuumed up while being pushed into the tailpipe 26. When the surface pumping stops the bias on the fingers 36 pushes them down to the closed position bridging the opening into the tailpipe 26. It should be appreciated that when in a horizontal orientation as depicted the captured debris 30 will simply stay in position and some of that debris could prevent the fingers from rotating into a closed position under the available spring bias. However, as the tailpipe 26 is moved to the vertical portion of the borehole, any sand below the fingers will fall away back into the vertical portion of the borehole to allow the fingers 36 to pivot to the close position to retain the captured debris 30 such as sand. Flow represented by arrow 16 leaves the sand 30 behind as it makes its way toward the screen 24. The assembly is advanced with string 12 from the surface as the debris 30 is sucked and pushed into tailpipe 26. Surface personnel try to match the advance rate of the tool 10 to the debris removal rate into the tailpipe 26.

As can be seen in the FIGURE the sand or debris 30 accumulates on the bottom of the tailpipe 26 in a horizontal run. As the debris builds the fluid velocity picks up through the narrowed opening taking some of the sand 30 that narrowed the opening in the first place with it as more sand 30 is also pulled through the restriction due to the increased velocity. Thus over time constrictions come and go at different locations. The horizontal run can extend to hundreds of feet in a horizontal run to capture a volume of 100's gallons in one experimental situation.

The layout shown in the FIGURE is a marked departure from past thinking that tried to keep inlet pipes short and vertical to assure that mill shavings or other debris would have enough velocity to be carried to the end of an inlet tube where it could then fall into an annular collection space as the uphole velocity dramatically slowed due to an enlarging of the housing cross-sectional area as the inlet pipe ended. Instead the present device provides a tailpipe 26 long enough to clean a long horizontal run of thousands of meters and does not experience clogging with debris as some skilled in the art would have imagined. Instead the tailpipe 26 is itself the collection location for the debris and in long horizontal runs can just lay on the bottom of the tailpipe 26.

The tailpipe 26 can extend from a vertical section of a borehole and past the heel and to the toe of the horizontal component of the borehole assuming there is well fluid available to keep the housing submerged. The tailpipe can be a factor of 100 times longer than the housing of the tool 10 and more.

The above description is illustrative of the preferred embodiment and many modifications may be made by those skilled in the art without departing from the invention whose scope is to be determined from the literal and equivalent scope of the claims below:

I claim:

1. A debris removal apparatus for a borehole comprising:

a housing having an uphole end for connection of a tubular string and a downhole end for connection of a tailpipe extending beyond said housing, said tailpipe comprises the capture location for debris removed from the borehole for retention therein as said housing is removed from the borehole, said debris captured by a capture device adjacent a lower end entry location of a straight passage defined by an innermost wall of said tailpipe and, said debris travelling in a single direction past said capture device for capture defined by retention by the capture device within said lower end;

said housing configured to conduct flow from the tubular string to outside said housing before reaching said tailpipe in a manner that draws debris laden fluid with vacuum into an inlet for said tailpipe while forcing fluid flowing between the borehole and said housing toward a lower end entrance to said tailpipe; and said tailpipe is at least 100 times longer than said housing.

2. The apparatus of claim 1, wherein:

said tailpipe further comprises a screen to retain at least some of the debris from exiting an uphole end of said tailpipe.

3. The apparatus of claim 1, wherein:

said capture device further comprises a shoe having at least one opening adjacent a downhole end thereof.

4. The apparatus of claim 1, wherein:

said tailpipe further comprising a one way valve adjacent said shoe.

5. The apparatus of claim 4, wherein:

said one way valve comprises a plurality of circumferentially spaced apart fingers or a flapper.

6. The apparatus of claim 5, wherein:

said fingers are biased toward a position transverse to a passage through said tailpipe to retain the debris in said passage.

7. The apparatus of claim 6, wherein:

said bias is overcome with flow through said passage which pivots said fingers out of said passage to allow debris to enter said passage.

8. A debris removal apparatus for a borehole comprising:

a housing having an uphole end for connection of a tubular string and a downhole end for connection of a tailpipe, said tailpipe comprises the capture location for debris removed from the borehole for retention therein as said housing is removed from the borehole; and said housing is configured to conduct flow from the tubular string to outside said housing in a manner that draws debris laden fluid into an inlet for said tailpipe while forcing fluid flowing outside said tailpipe toward said inlet for said tailpipe; and said tailpipe spans vertical and horizontal portions of a borehole.

9. A debris removal method from a substantially horizontal portion of a borehole, comprising:

attaching a tailpipe below a housing of a debris removal tool in a non-overlapping manner with said housing, said tailpipe being at least 100 times longer than said housing;

inserting the tailpipe into the substantially horizontal portion of the borehole;

pumping fluid through a supporting string connected to said housing such that the fluid exits above a lower end of said housing before reaching said tailpipe in a manner that draws with a vacuum debris laden fluid into a lower end of a passage in the tailpipe and pushes fluid along the borehole and outside of said housing down to said lower end of tailpipe and into the passage in the tailpipe;

retaining debris in said tailpipe passage;

removing the housing.

10. The method of claim 9, comprising:

advancing the tailpipe while capturing debris in the passage.

11. The method of claim 9, comprising:

retaining captured debris in the passage.

12. The method of claim 11, comprising:

providing a one way valve for said retaining.

13. The method of claim 12, comprising:

constructing the one way valve from a plurality of biased fingers or a flapper;

biasing said fingers to a position transverse to the passage when there is no fluid flow in the passage.

14. The method of claim 13, comprising:

overcoming said bias with flow through said passage to move said fingers to a position substantially out of the passage.

15. The method of claim 9, comprising:

providing a length on the tailpipe sufficient to reach a heel and extend toward a toe of the horizontal portion of the borehole while keeping said housing submerged in well fluid.

16. The method of claim 9, comprising:

capturing sand as the debris.

17. The method of claim 16, comprising:

using fluid velocity increases in said passage from sand accumulation to keep the sand moving in said passage for redistribution thereof.

* * * * *